US005536340A

United States Patent [19]

Ramaswamy

[11] Patent Number: 5,536,340

[45] Date of Patent: Jul. 16, 1996

[54] GAS GENERATING COMPOSITION FOR AUTOMOBILE AIRBAGS

[75] Inventor: Coodly P. Ramaswamy, Plant City, Fla.

[73] Assignee: Breed Automotive Technology, Inc., Lakeland, Fla.

[21] Appl. No.: 186,739

[22] Filed: Jan. 26, 1994

[51] Int. Cl.[6] ..... C06B 35/00

[52] U.S. Cl. ..... 149/35; 149/70; 149/76

[58] Field of Search ..... 149/38, 70, 76

[56] References Cited

U.S. PATENT DOCUMENTS

| | | | |
|---|---|---|---|
| 3,741,585 | 6/1973 | Hendrickson et al. | 280/150 AB |
| 3,947,300 | 3/1976 | Passauer et al. | 149/35 |
| 4,062,708 | 12/1977 | Goetz | 149/35 |
| 4,370,181 | 1/1983 | Lundstrom et al. | 149/2 |
| 4,533,416 | 8/1985 | Poole | 149/35 |
| 4,834,818 | 5/1989 | Kazumi et al. | 149/35 |
| 4,931,111 | 6/1990 | Poole et al. | 149/35 |
| 5,089,069 | 2/1992 | Ramaswamy et al. | 149/21 |

OTHER PUBLICATIONS

Reagent Chemical & Research Inc. Bulletin—Revised Jul. 1, 1986.

*Primary Examiner*—Peter A. Nelson
*Attorney, Agent, or Firm*—Kane, Dalsimer, Sullivan, Kurucz, Levy, Eisele & Richard

[57] ABSTRACT

A nitrogen gas-generating composition for use in airbags is prepared from an alkali metal azide and a heavy metal sulfide. The gas-generation is initiated by ignition of the composition and results in low residues of solid particulate material.

16 Claims, No Drawings

GAS GENERATING COMPOSITION FOR AUTOMOBILE AIRBAGS

BACKGROUND OF THE INVENTION

1. Field of Invention

The invention relates to gas generating compositions delivering a non-toxic gas, such as nitrogen, for filling automobile restraint airbags. More particularly, the invention relates to a composition of an alkali metal azide in combination with a heavy metal sulfide and initiating oxidizers to fill the airbag with nitrogen gas.

2. Brief Description of the Related Art

The development of automobile air bags to restrain occupants upon impact in a collision is a landmark in the field of automobile occupant safety. The devices are designed to deploy when vehicles travelling at 12 mph or greater experience sudden impact. The airbag is inflated and provides a soft barrier between the occupant and the interior of the vehicle, thereby averting serious or fatal injuries to an occupant.

Typically, the airbag system fitted in an automobile consists of a sensor, which picks up the crash pulse and with the aid of a booster composition sets off a gas generating composition housed in a module. The released gas fills up a fabric bag forming a barrier between the occupant and the interior of the vehicle. The sensors used operate either on mechanical or electro-mechanical principles. In a mechanical sensor a primer is set off, whereas in an electromechanical sensor an electro-explosive device (i.e., a squibb) is set off. In turn, the squibb sets off a booster composition (Boron-$KN0_3$) which activates the gas generating composition. The earliest gas generating compositions generated carbon-dioxide, but the state of the art is to generate nitrogen as the preferred airbag filling gas. Representative of the early nitrogen gas generating compositions for automobile airbags are those described in the U.S. Pat. No. 3,741,585 to Hendrickson et al. The state of the art gas generating compositions at the present time comprise an alkali metal azide, an oxidizer, and other additives. The gas generating compositions in use ordinarily use sodium azide as the preferred fuel. A variety of oxidizers have also been used.

Ideally, a gas generating composition for use in airbags should be a solid material, easily formed into pellets. Further, it should be non-hygroscopic and comprised of constituents which are obtainable in a relatively high degree of purity. The gas generating reaction should be easily controllable and generate the gas at the required rates and pressures. Also, the gas should produce a minimal amount of toxic gas residuals like carbon monoxide and oxides of nitrogen. The solids or slag residues formed during the reaction should be minimal and substantially retained in the combustion zone. Particles of the solid residues should be capable of being arrested in the filter system of the device. Most importantly, the slag residues should be non-toxic and generated in minimal amounts for ultimate disposal.

The gas-generating reaction should further be capable of being modified for different particular applications by either change of the physical parameters of the constituents or by use of suitable additives.

SUMMARY OF THE INVENTION

The invention comprises a solid composition which, upon ignition, decomposes into nitrogen gas and non-toxic solid particulates, and which comprises;

a metal azide;

an equivalent weight of a heavy metal sulfide; and an oxidizing agent selected from the group consisting of a metal oxide, an alkaline metal nitrate, or an alkaline metal perchlorate.

The composition is a low explosive, useful as a nitrogen gas-generating means to inflate airbag components in automobile driver/passenger restraint systems.

The term "low explosive" as used herein means a composition which undergoes autocombustion at rates which are low as compared with the rates of detonation of high explosives.

The use of the compositions of the invention permits modification, control, and activation of the gas-generating reaction. The solid residue particulates carried in the gas stream are within acceptable limits.

DETAILED DESCRIPTION OF THE PREFERRED EMBODIMENTS OF THE INVENTION

The metal azides which may be employed in preparing the compositions of the invention are well known as are methods of their preparation. Representative of the metal azides are the alkaline metal azides such as lithium azide, sodium azide, potassium azide; and the alkaline earth metal azides such as calcium azide, barium azide, magnesium azide and the like. The metal azide functions as a fuel, which upon ignition releases nitrogen gas.

The preferred metal azide used as fuel is sodium azide, which has 63% non-toxic nitrogen by weight. Sodium azide is a solid which can be ground into advantageous particle sizes with commercially available comminuting machines. Advantageously, the metal azide has particle sizes within the range of from 5 to 100 microns, preferably 10 to 25 microns.

Though a number of heavy metal sulfides can be used, the preferred heavy metal sulfides are iron sulfides such as ferrous sulfide, iron disulfide and the like. Preferred is ferrous sulfide. To obtain the most advantageous compositions of the invention the iron sulfide should have particle sizes within the range of from about 1 to about 50 microns, preferably 1 to 20 microns.

The control of the particle size of the constituent ingredients used in the compositions of the invention impact upon overall performance, of the gas generating composition particularly in relation to rate of combustion and the time-pressure profile of gas-release. Smaller grain sizes have increased surface area and burn more rapidly. The surface area and density of the compositions may be controlled to meet diverse end uses which should have minimal solids residues.

When initiated to autocombustion, the two ingredients described above react to release nitrogen gas and a residue of non-toxic, finely divided particulate matter which is readily excluded from the nitrogen gas stream.

The reaction may be initiated by the energy provided by a suitable booster material such as Boron-$KN0_3$. Since the reaction is exothermic, it is self-sustaining. With sodium azide as a representative azide, the reaction can be shown schematically by the equation $$2NaN_3 \rightarrow 2Na + 3N_2\uparrow + 10.2 \text{ kcals} \quad \text{(I)}$$

The sodium metal is scavenged in a second step by the heavy metal sulfide, for example ferrous sulfide.

In the second step, the sulfide of iron reacts with the sodium metal to form non-toxic sodium sulphide and iron metal according to the schematic formula:

$$2Na + FeS \rightarrow Na2S + Fe \quad \text{(II)}$$

In the case of iron disulfide, the reaction takes place according to the following equation:

$$FeS_2+4Na \rightarrow 2Na_2S+Fe. \quad (III)$$

By employing the azide and the sulfide reactants in stoichiometric proportions, i.e.; equal equivalent weights, the end products of reaction (II) form a high density solids mixture of non-toxic, finely divided particles that are readily retained in the combustor zone. Only a minute quantity of this solid residue is liable to escape in the high velocity nitrogen gas stream, and even in this instance the escaping solids may be retained within the combustor zone by a series of filters conventionally employed in surrounding the combustor zone. This results in very low levels of slag particulates entering the airbag and is one of the advantages of present invention. Conversely, in most of the gas generating compositions used prior hereto in airbags, sodium metal is converted into sodium oxide, which combines with additives to form a large quantity of slag. It is difficult to make this reaction occur with high efficiency while arresting the large residue of metal oxide particulates in the filter system.

It will be appreciated that the reaction (II) between sodium and ferrous sulfide by itself is generally slow and would not usually be appropriate for an airbag inflating composition. However, we have found that the reaction II can be initiated and accelerated in the presence of a small proportion of an oxidizer such as a metal oxide, an alkaline metal nitrate, an alkaline metal perchlorate and the like. As an oxidizer, potassium perchlorate and ammonium perchlorate are preferred. In the case of ammonium perchlorate, the products are all gaseous and hence do not contribute to particulate residues. Advantageously, the particle sizes of the oxides are within the range of 2 to 30 microns.

Representative of advantageous alkaline metal perchlorates are potassium perchlorate, sodium perchlorate, ammonium perchlorate and the like.

Representative of alkaline metal nitrates are potassium nitrate, sodium nitrate and the like.

The preferred oxidizer is potassium nitrate.

Similarly, high explosive compounds can be used to activate the reaction. High temperature stable, high explosives like nitroguanidine, cyclonite (RDX) and cyclotetramethylenetetranitramine (HMX) can be used in (small percentages) to initiate the reaction between the sodium and the iron sulfide.

Other additives which can be added to the compositions of the invention with advantage are minor proportions of processing aids that would enhance flow and pelletizing such as magnesium silicate and aluminum oxide. Lubricants are conventionally added. Examples of solid lubricants are molybdenum disulfide. As a lubricant, molybdenum disulfide is preferred, since it reacts with the sodium from step (I) in the reaction described above, to produce molybdenum metal and sodium sulfide products. These products in small quantity are not objectionable residues. Other useful additives include ground sulphur or atomized metal powders like aluminum to increase the heat of reaction and ignition capability. These additives are used in conventional proportions, generally not more than about 1–5% by weight of the total composition.

The ingredients of the compositions of the invention may be mixed in available commercial mixers with explosion-proof fittings. The compositions may be pelletized in multi-station rotary pellet presses to the desired weight, thickness and density.

The following examples and preparations describe the manner and process of making and using the invention and set forth the best mode contemplated by the inventor of carrying out the invention but are not to be construed as limiting the invention. Where reported, the following tests were carried out:

A method of assessing the gas generating compositions for diverse end uses is to load them in inflator housings that form a part of an airbag module. Testing is carried out in a static pressure tank of known volume by igniting the composition as used in the airbag system. The pressure-time (P-T) profile, as well as measurement of the toxic residuals in the gas and the particulates, are obtained by washing the tank, filtering, and weighing. Various manufacturers have used different volumes of the static tank and correlated the results to real-time conditions. In the experiments carried out on the gas generating compositions of the invention, a one cubic foot tank was used. To better represent real-time situations, 100 cubic foot is regarded within the industry as representing the interior volume of an automobile. Therefore, the result using the one cubic foot tank is reduced by a factor of 0.01 to approximate a 100 cubic foot volume.

All proportions are reported as percentage by weight.

PROCEDURE

Sodium azide and ferrous sulfide were ground to a selected particle size and mixed together in predetermined proportions with molybdenum disulfide as a lubricant. Magnesium silicate and aluminum oxide were added as flow assisting agents to obtain a homogeneous mix. The mixture was pelletized in a multi-station rotary pelleting press and pelletized to a desired weight, dimension and density.

EXAMPLES 1–5

These examples illustrate the effect of different additives on the functioning characteristics of the composition of the invention. The additives are identified in Table I, below.

TABLE I

| Composition | 1 | 2 | 3 | 4 | 5 |
|---|---|---|---|---|---|
| Sodium Azide | 58.5 | 58.0 | 58.5 | 58.5 | 58.0 |
| Ferrous Sulfide | 38.7 | 38.0 | 38.5 | 38.5 | 38.0 |
| Potassium Nitrate | | | 2.0 | | 3.0 |
| Molybdenum Disulfide | 1.0 | 1.0 | 1.0 | 1.0 | 1.0 |
| Aluminum | | 1.0 | | | |
| Iron Oxide ($Fe_2O_3$) | | 2.0 | | | |
| DNPT* | | | | 2.0 | |
| Sulfur | 1.8 | | | | |
| Load in gms | 63 | 63 | 63 | 63 | 63 |
| Pellet Weight in mgms | 160 | 130 | 130 | 130 | 130 |
| P-max in test tank (Kpa) | 240, 242 | 235, 243 | 249, 247 | 241, 245 | 247, 242 |
| Time for P-max (in milisecs.) | 45.7, 48.9 | 43.1, 68.9 | 37.1, 34.5 | 44.9, 39.3 | 38.5, 32.7 |
| Particulate in m. gms | 224, 199 | 208 | 141, 99 | 72, 64 | 65, 47 |

*DNPT = Dinitroso Pentamethylene Tetramine.

EXAMPLES 6–8

The functioning characteristics of the compositions of the invention can be modified by the addition of a high explosive base charge for detonation. The effect of the use of a typical high explosive, like nitroguanidine is illustrated in Table II below and would typify the effect of other high explosives like cyclotrimethylenetrinitramine or cyclonite (RDX) and cyclotetramethylenetetranitramine (HMX). The high explosives, when added, are added in proportions of from about 0.1 to 2 percent by weight.

TABLE II

| Composition | 6 | 7 | 8 |
|---|---|---|---|
| Sodium Azide | 58.0 | 58.0 | 58.0 |
| Ferrous Sulfide | 38.0 | 38.0 | 38.0 |
| Molybdenum Disulfide | 1.0 | 1.0 | 1.0 |

TABLE II-continued

| Composition | 6 | 7 | 8 |
|---|---|---|---|
| Potassium Nitrate | 3.0 | 2.5 | 2.0 |
| Nitroguanidine | | 0.5 | 1.0 |
| Load in gms. | 78 | 78 | 78 |
| Pellet Weight in m. gms. | 160 | 160 | 160 |
| P-max in K. Pas. | 362, 354 | 367, 383, 364 | 371, 367, 369 |
| dp/dt | 16.1 | 17.3, 20.10, 18.1 | 14.4, 14.9, 17.0 |
| Time for P-max in m. secs | 49.0, 45.8 | 41.6, 45.6, 48.6 | 46.6, 48.8, 53.0 |
| Particulates in m. gms | 49, 154 | 287, 228, 309 | 210, 237, 276 |

EXAMPLES 9–12

Particle size control aids in providing consistent, repeatable and desired functioning characteristics. The effect of variation of particle size of the main constituents, namely sodium azide and ferrous sulfide is illustrated in Table III, below.

TABLE III

| Composition | 9 | 10 | 11 | 12 |
|---|---|---|---|---|
| Sodium Azide | 58 (10–21μ) | 58 (13–21μ) | 58 (60μ) | 58 (60μ) |
| Ferrous Sulfide | 38 (2–5μ) | 38 (13–15μ) | 38 (2–8μ) | 38 (13–15μ) |
| Molybdenum Disulfide | 1.0 | 1.0 | 1.0 | 1.0 |
| Potassium Nitrate | 3.0 | 3.0 | 3.0 | 3.0 |
| Load in gms. | 78 | 78 | 78 | 78 |
| Pellet Wt. in M. gms. | 160 | 160 | 160 | 160 |
| P-max in K-Pas | 362, 354 | 331, 343, 338 | 352, 358, 369 | 327, 297, 310 |
| dp/dt | 16.1, 16.0 | 9.8, 11.1, 9.6 | 7.3, 7.3, 8.0 | 6.1, 5.0, 5.1 |
| Time for P-max in m. secs. | 49.0, 48.8 | 80.8, 73.2 | 98.6, 96.8, 96.6 | 98.7, 98.4 |
| Particulate in m. gms. | 149, 154 | 113, 109, 102 | 538, 318, 296 | 625, 286, 110 |

Particle size of the azide component is smaller in Example 9 relative to the other examples. Example 9 also exhibits a faster pressure/time response relative to the other examples. Smaller particle size effects response time in a favorable manner.

EXAMPLES 13–14

The functioning characteristics of the compositions of the invention can be effected by altering the surface area of the propellant available for burning. The effect of this parameter on the functioning characteristics of the composition of the invention is given in Table IV, below.

TABLE IV

| Composition | 13 | 14 |
|---|---|---|
| Sodium Azide | 58.0 | 58.0 |
| Ferrous Sulfide | 38.0 | 38.0 |
| Molybdenum Disulfide | 1.0 | 1.0 |
| Potassium Nitrate | 3.0 | 3.0 |
| Load in gms | 78 | 78 |
| Pellet Weight in mgms | 160 | 160 |
| Surface Area Available in SQ mms/gm Propellant | 436 | 623 |
| P-max in Kpas | 334, 338 | 362, 354 |

TABLE IV-continued

| Composition | 13 | 14 |
|---|---|---|
| dp/dt | 10.7, 11.0 | 16.1, 16.0 |
| Time for Pmax in miliseconds | 64.6, 67.2 | 49.0, 48.8 |
| Total Particulates in mili-grams | 177, 135 | 149, 154 |

Increased surface area results in a faster pressure time response, and therefore influences response time in a favorable manner. Advantageously, the surface area available is within the range of from about 200 to 1000 mms/gms, preferably 400 to 800.

EXAMPLES 15–16

The density of the pellets has considerable effect on the functioning characteristics of the composition. This example illustrates the effect of this parameter on the composition of the invention and detailed in Table V, below.

TABLE V

| Composition | 15 | 16 |
|---|---|---|
| Sodium Azide | 58.0 | 58.0 |
| Ferrous Sulfide | 38.0 | 38.0 |
| Molybdenum Disulfide | 1.0 | 1.0 |
| Potassium Nitrate | 3.0 | 3.0 |
| Load in gms | 78 | 78 |
| Pellet Weight in miligms | 160 | 160 |
| Density of Pellets in gms/cc | 2.0 | 2.25 |
| Pmax in Kpas | 403, 397, 399 | 362.3, 354.4 |
| dp/dt | 22.1, 24.4, 24.8 | 16.1, 16.0 |
| Time for Pmax in miliseconds | 39.0, 38.0, 41.0 | 49.0, 48.8 |
| Total Particulates in miligms | 204, 268 | 149, 154 |

A density range of from about 1.5 to 2.75 gms/cc is advantageous, preferably 2.0 to 2.15.

EXAMPLES 17–19

By varying the load of the propellant used, the functioning characteristics can be altered. The effect of varying the load of the propellant is set forth in Table VI.

TABLE VI

| Composition | 17 | 18 | 19 |
|---|---|---|---|
| Sodium Azide | 58.0 | 58.0 | 58.0 |
| Ferrous Sulfide | 38.0 | 38.0 | 38.0 |
| Molybdenum Disulfide | 1.0 | 1.0 | 1.0 |
| Potassium Nitrate | 3.0 | 3.0 | 3.0 |
| Load in gms | 63 | 78 | 86 |
| Pellet Weight in milligms | 160 | 160 | 160 |
| P-max in K. Pas. | 267, 262 | 362, 354 | 402, 403 |
| dp/dt | 10.1, 9.2 | 16.1, 16.0 | 21.6, 19.6 |
| Time for P-max in millisecs | 58.6, 57.4 | 49.0, 48.8 | 41.2, 43.2 |
| Total Particulates in milligms | 144, 90 | 149, 154 | 267, 319 |

While pressure-time response is somewhat slower for heavier loads, higher maximum pressures are realized in relatively shorter periods of time.

EXAMPLE 20

Sodium azide and ferrous sulfide can be mixed together in equal equivalent weight proportions after comminuting them to desired particle sizes, along with molybdenum disulfide as a lubricant. A gas generating composition of this kind has the following functioning characteristics.

TABLE VII

| | |
|---|---|
| Sodium Azide | 59.5 |
| Ferrous Sulfide | 39.5 |
| Molybdenum Disulfide | 1.0 |
| Load in gms | 78 |
| Weight of Pellet in milligms | 160 |
| P-max in K-Pas | 345, 346, 350 |
| dp/dt | 14.8, 13.8, 13.2 |
| Time of Pmax in milliseconds | 50.8, 51.0, 56.4 |
| Particulates in milligms | 292.3, 350.7, 345.0 |

EXAMPLES 21–24

Ferrous sulfide may be replaced with iron disulfide. The reaction takes place in a manner as indicated earlier with the formation of an innocuous solid as slag containing iron and sodium sulfide. A typical composition made in this manner and tested under different loads and conditions, has results as indicated in Table VIII, below.

TABLE VIII

| Composition | 21 | 22 | 23 | 24* |
|---|---|---|---|---|
| Sodium Azide | 67.0 | 67.0 | 67.0 | 67.0 |
| Iron Disulfide | 31.0 | 31.0 | 31.0 | 31.0 |
| Magnesium Silicate** | 1.0 | 1.0 | 1.0 | 1.0 |
| Aluminum Oxide | 1.0 | 1.0 | 1.0 | 1.0 |
| Load in gms. | 65 | 69.5 | 68.0 | 69.5 |
| Pellet Wt. in M. gms. | 160 | 160 | 160 | 160 |
| P-max in K-Pas | 331, 333, 333, 336 | 373, 367 | 319, 322 | 350, 354 |
| dp/dt | 13.5, 12.5, 12.9, 13.2 | 15.4, 15.0 | 16.6, 16.9 | 12.7, 14.1 |
| Time for P-max in m. secs. | 57.8, 59.2, 62.2, 59.4 | 55.2, 54.0 | 46.2, 46.0 | 59.6, 53.0 |
| Total Particulate in m. gms. | 204.9, 235.0, 185.0, 242 | 412, 303 | 95.7, 115.2 | 136.7, 167.7 |

*Utilized a modified filter system, different from Examples 21 and 22. Whereas Examples 21 and 22 were conducted with a 25μ screen as the final particulate control filter, Examples 23 and 24 were conducted with an additional 40μ screen in front of the 25μ screen.
**MAGNESOL ®, Reagent Chemical and Research Inc., 124 River Road, Middlesex, New Jersey, Technical Brochure Rev. 1, July 1986.

EXAMPLES 25–26

The potassium nitrate oxidizer used to activate the composition can be replaced by potassium perchlorate after grinding it to a desired size. A typical composition made using potassium perchlorate and its effect on the functioning characteristics at various loads are illustrated in Table IX, below.

TABLE IX

| Composition | 25 | 26 |
|---|---|---|
| Sodium Azide | 59.0 | 59.0 |
| Ferrous Sulfide | 39.0 | 39.0 |
| Molybdenum Disulfide | 1.0 | 1.0 |
| Potassium Perchlorate | 1.0 | 1.0 |
| Pellet wt. in mgs | 160 | 160 |
| Load in gms | 78 gm | 92 gm |
| Density of Pellet in gms/cc | 2.25 | 2.25 |
| Pmax in K-Pas | 354, 347, 346 | 401, 413, 418 |
| dp/dt | 14.8, 13.5, 13.1 | 14.5, 14.4, 16.6 |
| Time for Pmax in m. secs | 45.4, 45.4, 47.0 | 52.4, 54.4, 47.0 |
| Total Particulate in m. gms | 209, 208, 216 | 305, 336, 332 |

TABLE IX-continued

| Composition | 25 | 26 |
|---|---|---|
| Test condition | Ambient | Ambient |

EXAMPLES 27–28

The potassium nitrate oxidizer used to activate the composition can be replaced by ammonium perchlorate after grinding it to a desired size. A typical composition made using ammonium perchlorate and its effect on the functioning characteristics at various loads is illustrated in Table X, below.

TABLE X

| Composition | 27 | 28 |
|---|---|---|
| Sodium Azide | 59.0 | 59.0 |
| Ferrous Sulfide | 39.5 | 39.5 |
| Ammonium Perchlorate | 1.5 | 1.5 |
| Pellet wt. in mgs | 220.0 | 220.0 |
| Load in gms | 76 gm | 86 gm |
| Density of Pellet in gms/cc | 2.25 | 2.25 |
| Pmax in K-Pas | 334, 325, 330 | 416, 413, 416 |
| dp/dt | 16.1, 17.1, 14.1 | 23.1, 21.8, 20.2 |
| Time for Pmax in m. secs | 54.6, 48.2, 54.4 | 47.4, 50.8, 47.2 |
| Total Particulate in m. gms | 563, 467, 658 | 766, 712, 741 |
| Test Condition | Ambient | Ambient |

What is claimed is:

1. A solid composition which, upon ignition, decomposes into nitrogen gas and non-toxic solid particulates, and which comprises; equivalent weights of (a) a metal azide; and (b) a heavy metal sulfide; and an oxidizing proportion of an oxidizing agent selected from the group consisting of a metal oxide, an alkaline metal nitrate, and an alkaline metal perchlorate.

2. The composition of claim 1 wherein the heavy metal sulfide is an iron sulfide.

3. The composition of claim 2 wherein the iron sulfide is ferrous sulfide.

4. The composition of claim 2 wherein the iron sulfide is iron disulfide.

5. The composition of claim 1 wherein a flow-additive is present.

6. The composition of claim 5 wherein the flow-additive is magnesium silicate.

7. The composition of claim 1 wherein the oxidizing agent is potassium nitrate.

8. The composition of claim 1 wherein the oxidizing agent is potassium perchlorate.

9. The composition of claim 1 wherein the oxidizing agent is ammonium perchlorate.

10. The composition of claim 1 wherein the metal azide is sodium azide.

11. The composition of claim 1 formed into pellets having a density in the range of 1.5 to 2.75 gms/cc.

12. The composition of claim 1 wherein the metal azide has a particle size in the range of 5 to 100 microns.

13. The composition of claim 1 wherein the sulfide has a particle size in the range of 1 to 50 microns.

14. The composition of claim 1 wherein the particles of the composition have a surface area in the range of 200–1000 $mm^2$/gm.

15. A solid composition which, upon ignition, decomposes into nitrogen gas and non-toxic solid particulates, and which comprises; equivalent weights of (a) a metal azide; and (b) a heavy metal sulfide; and an oxidizing proportion of an oxidizing agent selected from the group consisting of a metal oxide, an alkaline metal nitrate, and an alkaline metal perchlorate;

(c) a high explosive selected from the group consisting of nitroguanidine, cyclonite and cyclotetramethylenetetranitramine.

16. The composition of claim 1 which further comprises a lubricating proportion of molybdenum disulfide.

* * * * *